US009586098B1

(12) United States Patent
Ahsan

(10) Patent No.: US 9,586,098 B1
(45) Date of Patent: Mar. 7, 2017

(54) SPORTS BALL AND METHOD OF MANUFACTURING SPORTS BALL

(71) Applicant: Zain-Ul-Abideen Ahsan, Sialkot (PK)

(72) Inventor: Zain-Ul-Abideen Ahsan, Sialkot (PK)

(73) Assignees: Zain-Ul-Abideen Ahsan, Sialkot (PK); Ahsan Naeem, Sialkot (PK)

( * ) Notice: Subject to any disclaimer, the term of this patent is extended or adjusted under 35 U.S.C. 154(b) by 0 days.

(21) Appl. No.: 15/153,301

(22) Filed: May 12, 2016

Related U.S. Application Data

(60) Provisional application No. 62/280,260, filed on Jan. 19, 2016.

(30) Foreign Application Priority Data

Jan. 12, 2016 (PK) ..... 27/2016

(51) Int. Cl.
*A63B 41/08* (2006.01)
*A63B 45/00* (2006.01)

(52) U.S. Cl.
CPC ..... *A63B 41/08* (2013.01); *A63B 45/00* (2013.01)

(58) Field of Classification Search
CPC ..... A63B 41/08; A63B 41/02; A63B 41/10; A63B 45/00
See application file for complete search history.

(56) References Cited

U.S. PATENT DOCUMENTS 4,191,375 A 3/1980 Uruba et al.
5,772,545 A * 6/1998 Ou ..... A63B 41/00 156/170
5,997,422 A * 12/1999 Cooper ..... A63B 41/08 473/599
6,039,662 A * 3/2000 Chan ..... A63B 41/08 473/599
6,348,018 B1 * 2/2002 Ou ..... A63B 41/08 473/143
6,390,941 B1 5/2002 Ou
6,503,162 B1 * 1/2003 Shishido ..... A63B 41/08 473/599
6,645,100 B2 11/2003 Guenther et al.
(Continued)

FOREIGN PATENT DOCUMENTS

EP 1 424 105 A1 6/2004
EP 2 072 093 A1 6/2009
(Continued)

*Primary Examiner* — Steven Wong
(74) *Attorney, Agent, or Firm* — Taft Stettinius & Hollister LLP

(57) ABSTRACT

A method for manufacturing a sports ball comprises cutting outer panels and inner padding cut-outs from three different sheet materials. The padding layer materials have perforations. A layer of heat-reactive adhesive that expands upon heating is applied in the machine-stitched seam areas before the panels are stitched together. The padding layer is glued to the inside-out ball cover before the cover is turned right-side out. A reinforced bladder is inserted into the cover, the remaining seams are stitched shut, and then the ball is molded in a heat and pressure mold that causes the seams to be welded as well as stitched, due to the expansion of the heat-reactive adhesive to cover the stitching in the seams. Enhanced performance characteristics of the resulting ball arise from the air spring aspects provided by the combined features.

24 Claims, 11 Drawing Sheets

(56) References Cited

U.S. PATENT DOCUMENTS

| | | | | |
|---|---|---|---|---|
| 6,663,520 | B2 * | 12/2003 | Ou Chen | A63B 41/00 473/604 |
| 6,726,583 | B1 | 4/2004 | Lai | |
| 6,793,597 | B2 | 9/2004 | Awan | |
| 6,916,262 | B2 | 7/2005 | Lacroix et al. | |
| 6,971,965 | B1 * | 12/2005 | Shishido | A63B 41/08 473/604 |
| 7,645,203 | B2 | 1/2010 | Tang et al. | |
| 7,749,116 | B2 | 7/2010 | Tang et al. | |
| 7,753,813 | B2 | 7/2010 | Taniguchi et al. | |
| 8,216,098 | B2 | 7/2012 | Lalvani | |
| 8,708,847 | B2 | 4/2014 | Berggren et al. | |
| 8,771,115 | B2 | 7/2014 | Berggren et al. | |
| 8,926,459 | B2 | 1/2015 | Berggren et al. | |
| 8,974,330 | B2 | 3/2015 | Berggren et al. | |
| 8,991,033 | B1 | 3/2015 | Hussain | |
| 9,011,621 | B1 | 4/2015 | Hussain | |
| 9,101,802 | B2 | 8/2015 | Hussain | |
| 9,186,559 | B1 | 11/2015 | Hussain | |
| 2002/0086749 | A1 * | 7/2002 | Ou | A63B 41/00 473/604 |
| 2003/0228946 | A1 | 12/2003 | Chan | |
| 2005/0277499 | A1 * | 12/2005 | Tang | A63B 41/085 473/604 |
| 2006/0046880 | A1 | 3/2006 | Tang et al. | |
| 2006/0229149 | A1 | 10/2006 | Goedoen | |
| 2009/0117295 | A1 | 5/2009 | Latham et al. | |
| 2009/0325744 | A1 | 12/2009 | Raynak et al. | |
| 2009/0325745 | A1 | 12/2009 | Rapaport et al. | |
| 2009/0325747 | A1 * | 12/2009 | Ou | A63B 41/08 473/605 |
| 2010/0144470 | A1 | 6/2010 | Lin | |
| 2010/0167850 | A1 * | 7/2010 | Lin | A63B 41/00 473/605 |
| 2011/0207564 | A1 | 8/2011 | Goodall et al. | |
| 2012/0088614 | A1 | 4/2012 | Bulfin | |
| 2012/0202627 | A1 | 8/2012 | Raynak et al. | |
| 2012/0277044 | A1 * | 11/2012 | Berggren | A63B 41/08 473/607 |
| 2014/0088454 | A1 | 3/2014 | Mack | |
| 2014/0243124 | A1 | 8/2014 | McNamee | |

FOREIGN PATENT DOCUMENTS

| | | | |
|---|---|---|---|
| JP | 2000-245875 | A | 9/2000 |
| JP | 2001-170216 | A | 6/2001 |

* cited by examiner

SPORTS BALL AND METHOD OF MANUFACTURING SPORTS BALL

CROSS-REFERENCE TO RELATED APPLICATIONS

Priority is claimed to U.S. Provisional Patent Application No. 62/280,260, filed on Jan. 19, 2016, the contents of which are incorporated by reference herein in their entirety, and to Pakistan Patent Application No. 27/2016, filed on Jan. 15, 2016, the contents of which are incorporated by reference herein in their entirety.

TECHNICAL FIELD

The present disclosure relates generally to a sports ball and a method for manufacturing a sports ball. More particularly, and without limitation, the present disclosure relates to structures and methods for manufacturing a sports ball for use in games such as soccer, volleyball, football, and other sports.

BACKGROUND

Traditional hand-sewn sports balls have various drawbacks related to loosened or exposed stitching, high water up-take, inconsistent performance characteristics, low production efficiency, and high production cost. Labor costs for hand-sewn sports balls are high, and constantly increasing every year. There is a shortage of sewers to perform the hand-sewing, which tends to increase the stitching cost involved in making hand-sewn sports balls. Long manufacturing times are required for hand-sewn sports balls; typical production times may be four to six weeks. Current processes in manufacturing hand-sewn sports balls result in a lot of waste of materials. Stitching of hand sewn sports balls can easily become loose (exposed) which give the sports balls poor durability in terms of weak abrasion resistance, and high water up-take that can make a sports balls heavier than desired.

SUMMARY OF THE INVENTION

An object of the invention is to provide a new and improved sports ball having the physical characteristics of a hand-sewn sports ball with better softness and durability. Improved performance and durability characteristics are provided by features of panels that are stitched together by machine and also welded by heat-activated expanding glue. The stitched and welded seams work together with perforations in the internal padding layer and the internal valve padding layer to provide an air spring effect that improves softness, responsive bounce, and true flight characteristics in a water-resistant ball. Another object is providing an improved method for manufacturing sports balls having such features.

DETAILED DESCRIPTION

Figure 1:
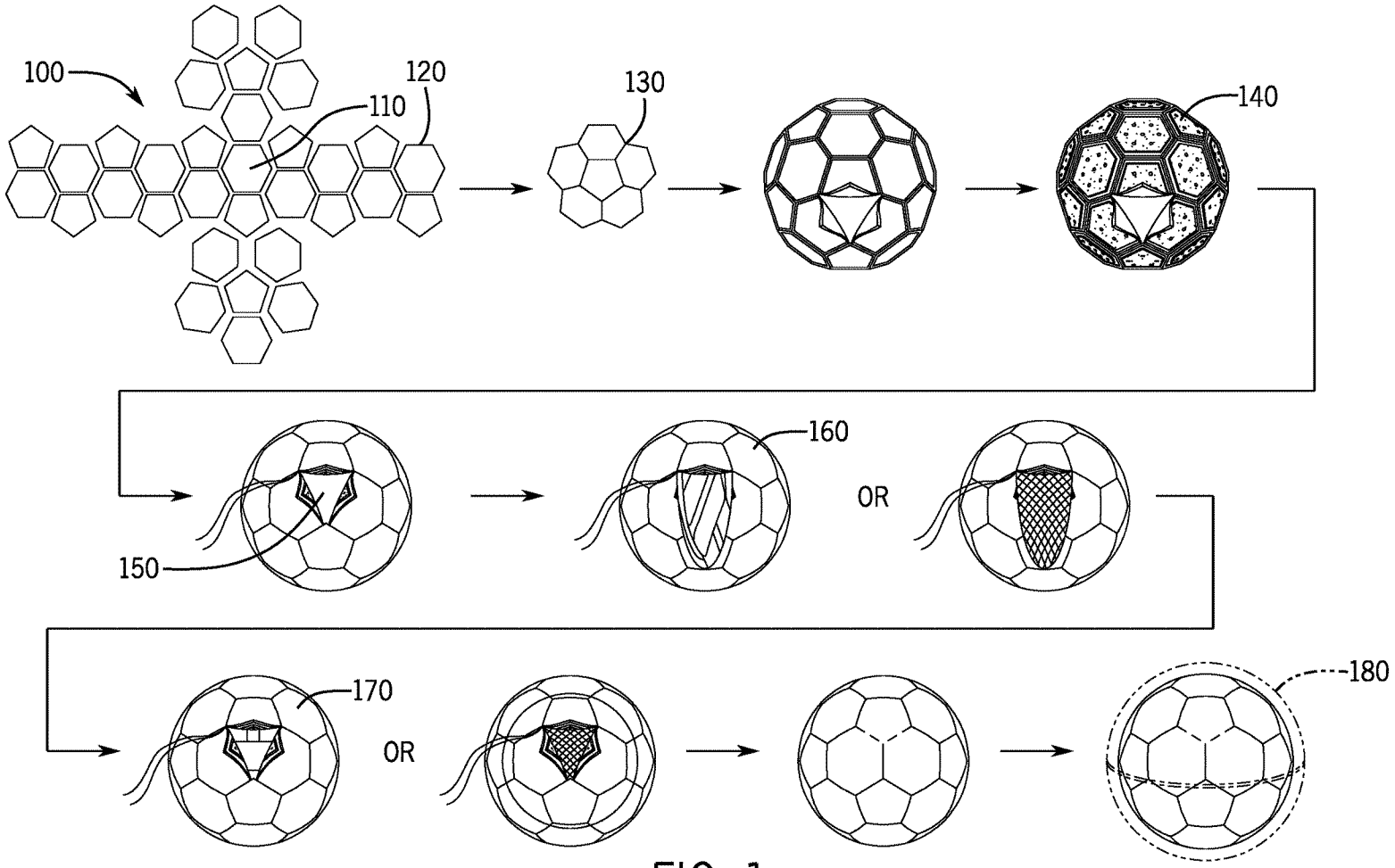
FIG. 1 is a diagram showing steps in a method for manufacturing a sports ball according to the invention.

FIG. 1 schematically represents steps in the sports ball manufacturing method 100 according to the invention. In the cutting step 110, a plurality of outer panel pieces 1 are cut out from a first sheet material 16, which is a laminated sheet material. Also, an outer panel piece that has a valve hole cut into it, valve hole panel 2, is cut from the first sheet material 16. A plurality of internal padding layer cut-outs 6 are cut from a second sheet material 21, and an internal valve padding layer cut-out is cut from a third sheet material 22. The sheet materials are described in more detail below. The shape of the panel cut-outs cut from first sheet material 16 is shown as hexagonal in the embodiment depicted in FIG. 1. However, various shapes of the panel pieces can be used, as explained later with respect to FIGS. 22-26.

Figure 2:
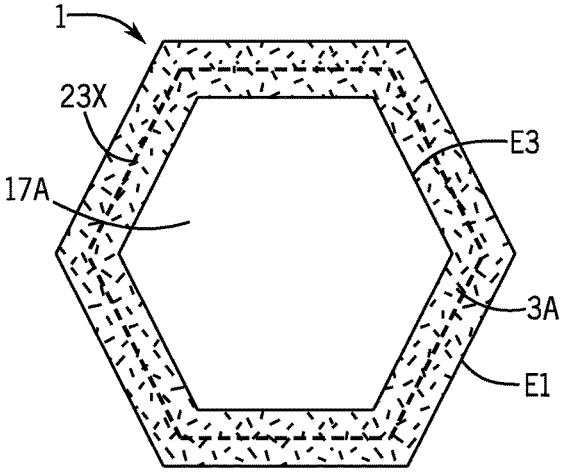
FIG. 2 is a top view of a cut-out panel with adhesive applied to its peripheral edges and showing positions of the stitch lines

In the adhesive application step 120 shown in FIG. 1, a layer of adhesive or glue is coated onto the outermost (top) surface of the outer casing of the panel cut-outs 1 and 2. The outermost (top) surface 17A of the casing 17 of the cut-out panels 1 and 2 will be the exterior surface of the ball after manufacturing has been completed. As seen in FIG. 2, the layer of glue 3A is coated along all of the peripheral edges of the top surface 17A of the panels 1 and 2. The area of the glue coating is designated as 3A in FIG. 2. The position of the lateral edge of the panel 1 is designated as E1 in FIG. 2. The glue coating area 3A begins along the lateral edge E1 of panel 1. The glue coating area ends at a point designated as E3, positioned approximately 3.5 mm to 4.0 mm from the lateral edge E1, so that the total width of the band of glue coating 3A measured from the lateral edge E1 of the panel is approximately 3.5 mm to 4.0 mm. The stitch line 23X is positioned approximately 2.5 mm from the lateral edge E1. It is noted that the depictions of FIG. 2 are merely schematic representations, and are not drawn to scale.

In the next step shown in FIG. 1, the stitching step 130, the plurality of panels 1 are stitched together along their edges, such that the panels 1 form an inside-out ball cover 4. The stitching is performed along stitch lines generally shown along the dotted line 23X as depicted in FIG. 2. Seam allowances or inlays are left to extend outwardly between the stitch lines 23X and the outer lateral side edges E1 of the panels 1, as depicted between steps 130 and 140, and depicted in FIG. 2. The thread used for stitching is preferably comprised of high density polyester yarn filaments. A preferred thread is specially designed to have a very high strength, to allow a sewing machine to stitch with a high thread tension, giving the sports ball very tight stitching 23. The valve panel 2 also is similarly stitched to adjoining panels 1. As shown between steps 130 and 140 in FIG. 1, an inlet opening 9 (see FIG. 7) is left unstitched and open.

As shown in FIG. 1, in the step 140 of attachment of the internal padding layer 6, an internal padding layer cut-out 6 is attached to each one of the panels 1. As seen in FIGS. 22A through 25, the internal padding layer cut-out 6 is cut into the same shape as its corresponding outer panel cut-out 1. Each inner panel cut-out 6 adhered to each panel is, however, of a slightly smaller size than its corresponding outer panel cut-out 1. In this manner, preferably the adhered inner panel does not extend into the stitch line 23.

The attachment is made using a layer of glue or adhesive between the internal padding layer 6 and the panel 1. One of the panels is the valve hole panel 2 (see FIG. 3). Valve hole panel 2 has a valve hole cut into it that will receive insertion of the bladder valve 11. On that panel, the internal valve padding layer 14 that is adhered to it is different from the other padding layer cut-outs 6, in that it is cut from a different laminated sheet material 22. The internal valve padding layer 14 also has a valve hole cut through it, valve hole 15, which is aligned with the valve hole in its corresponding valve hole panel 2 and also will receive insertion of the bladder valve 11.

In the cover turning step 150, the padded inside-out ball cover 5 is turned to be right-side out ball cover 8, such that the adhered internal padding layer 6 is on the inside of the turned cover 8. Then, the bladder is inserted into the cover 8 in a bladder insertion step 160. The bladder preferably is formed of elastomer rubber components, such as latex, butyl rubber, or a mixture thereof. The bladder has a valve 11 (see reference numeral 11 in FIG. 3), and preferably is reinforced, i.e., "restricted" to a particular desired size and shape. The reinforcement is made before the insertion step 160, and is described in more detail later.

The bladder is then deflated for the insertion step 160, wherein the deflated restricted bladder 10A or 10B is inserted inside the ball cover 8 through the inlet opening 9. The valve 11 is aligned with and inserted through the valve hole 15 in the internal valve padding layer 14 and through the corresponding valve hole in the corresponding valve hole panel 2, such that the valve 11 projects outwardly to the exterior of the ball cover 8. Preferably the padding layer 14 is adhered to the bladder in its area surrounding the valve 11.

After insertion 160, the final closure step 170 is conducted. The inlet opening 9 is closed by stitching it closed. Then, in the molding step 180, the ball is placed into a mold 13 for heat and pressure molding, as described below, to achieve its final shaping, sealing, and welding shut.

FIGS. 3-6 show more details of the reinforced (or "restricted") bladder, with an unsewn valve panel 2 attached, to show the placement of the valve panel 2 with respect to the bladder. As mentioned above, the restriction of the bladder is achieved by winding all around the inflated rubber bladder with string or yarn, and adhering the string or yarn to the bladder with adhesive (see string-wrapped bladder 10A in FIG. 3), or by wrapping or laminating the inflated bladder with one or more layers of fabric, and adhering the fabric to the bladder using adhesive (see fabric-wrapped bladder 10B in FIG. 4). The restriction or reinforcement is undertaken in order to maintain the specific ball size that is required under game regulations, with the required air pressure inside the ball. The restricted bladder (or "carcass") can preferably be formed with a webbing of yarn dipped in latex or adhesives put onto the bladder, or fabric pasted on bladder with latex or adhesives.

Figure 3:
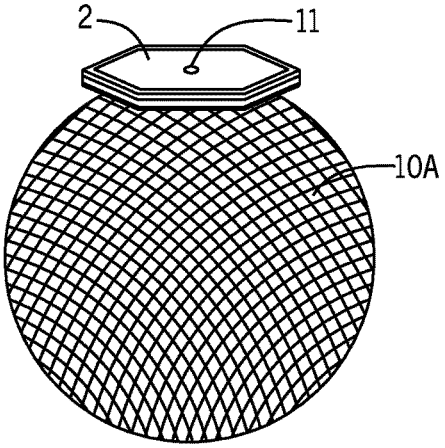
FIG. 3 is an upper front perspective view of a string-wound bladder with attached valve hole panel.
Figure 4:
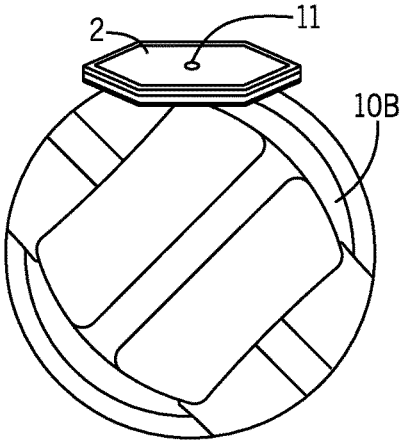
FIG. 4 is an upper front perspective view of a fabric-wrapped bladder with attached valve hole panel.
Figure 5:
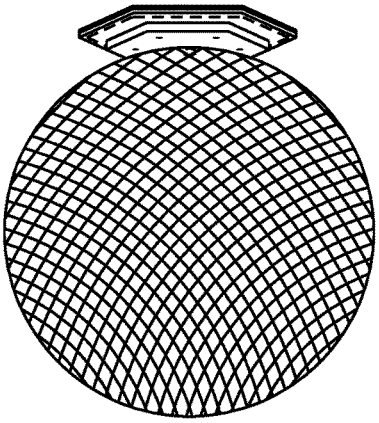
FIG. 5 is a lower front perspective view of a string-wound bladder with attached valve hole panel showing internal valve padding layer.
Figure 6:
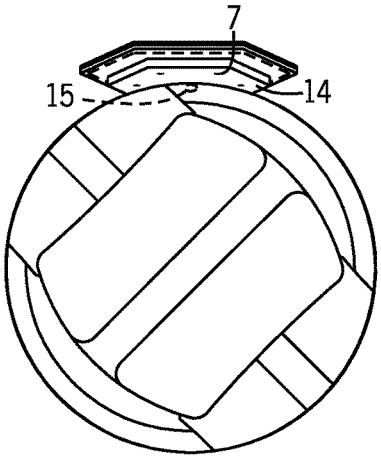
FIG. 6 is a lower front perspective view of a fabric-wrapped bladder with attached valve hole panel showing internal valve padding layer.

FIGS. 3 and 4 show upper front perspective views of, respectively, the string-wound bladder 10A (FIG. 3) with the attached valve hole panel 2, and the fabric-wrapped bladder 10B (FIG. 4) with attached valve hole panel 2. FIGS. 5 and 6 show lower front perspective views of the string-wound bladder 10A and fabric-wound bladder 10B, respectively, with attached valve hole panels 2 and showing the position of internal valve padding layer 14 with its valve hole 15 aligned to receive insertion of the valve 11. As seen in FIGS. 5-6, the internal valve padding layer 14 is affixed by glue to its corresponding cut-out valve hole panel 2. This internal valve padding layer 14 and its corresponding valve hole panel 2 each have a valve hole (reference numeral 15 in the padding layer 14; not shown in panel 2) for receiving insertion of the valve 11 of the bladder. After insertion of the bladder as set forth below, the valve 11 will be aligned with the valve holes and inserted through them, so that the outer end of the valve 11 will extend to the outer surface of the ball after the manufacture of the ball has been completed.

Figure 7:
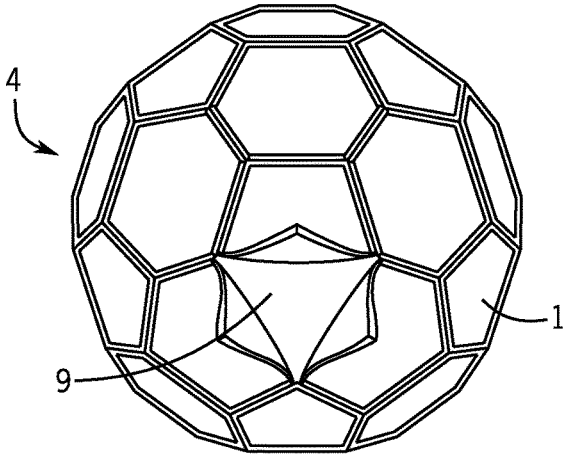
FIG. 7 is a front view of a ball cover after stitching.

FIG. 7 shows the ball cover 4 before the process 140 of adhering the internal padding layer. All but some of the plurality of panels 1 with a coating of glue 3A on all their edges have been stitched together in the stitching step 130 to form a ball cover 4 in an inside-out condition. Some panels 1 which are left unstitched form the inlet opening 9. The panels which have been left unstitched also have all of their edges coated with glue 3A. Inlet opening 9 preferably is divided into three parts or seams.

After the stitching process 130, the glue 3A which was coated on all the edges of the top surface of each panel 1 comes within the stitched area after the stitching. The stitching turns the sides of the panels 1, and hence the glue 3A coated on the panel edges comes within the stitching area. The sides of the plurality of panels become seams after the stitching process. The seam is the area between two adjoining panels 1, which forms a V-shaped depression in the surface of the finished ball. The V-shape allows the sports ball to have true flight characteristics. The inclusion of glue 3A in the stitch line area helps to tighten the stitching of the ball cover. Further, the inclusion of the glue 3A in this area yields a finished ball cover with an exterior surface that does not have a lot of exposed threads in its seams; the seams may be essentially thread-less because the expanded glue covers all the stitches.

The glue 3A used for making the sports ball is heat-activated, and preferably is an adhesive composed of polyurethane or other suitable adhesive or emulsions, or compositions containing the same. The glue 3A is activated during the final shaping step 180 in the mold; activated glue is depicted as glue 3B in the drawing figures. After this activation, the glue welds adjoining panels to one another. Thus, adjoining panels 1 are connected by welding, as well as by stitching. This welding by the activated glue 3B increases the durability of the finished sports ball. The welding also tends to reduce water up-take by the finished ball manufactured by this method. The resulting ball water up-take is limited to less than 10% by weight, which keeps the ball weight within standard requirements under game regulations, and allows the players to have longer playability with the ball.

Figure 8:
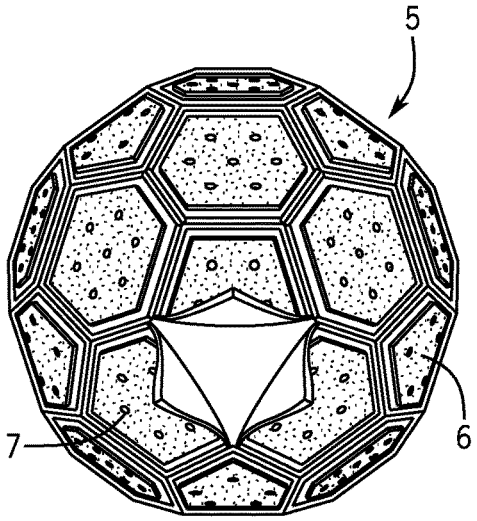
FIG. 8 is a front view of a ball cover after attachment of an internal padding layer.

FIG. 8 shows the inside-out ball cover 5 with the internal padding layer 6 attached to the bottom (inner) surface of the panels 1. The innermost (bottom) surface of the panels 1 will later be inside of the finished cover, after the cover gets turned right-side out. The panels 1 of the ball cover have been covered with an adhesive to which the internal padding layer 6 is adhered. An internal valve hole padding layer 14 also is attached in a similar way, as part of this internal padding layer application step 140. As can be seen in FIG. 8, the internal padding layer has perforated holes 7. The internal valve hole padding layer 14 also has such perforated holes 7, and in addition has a larger valve hole 15 for receiving insertion of the valve 11.

Figure 9:
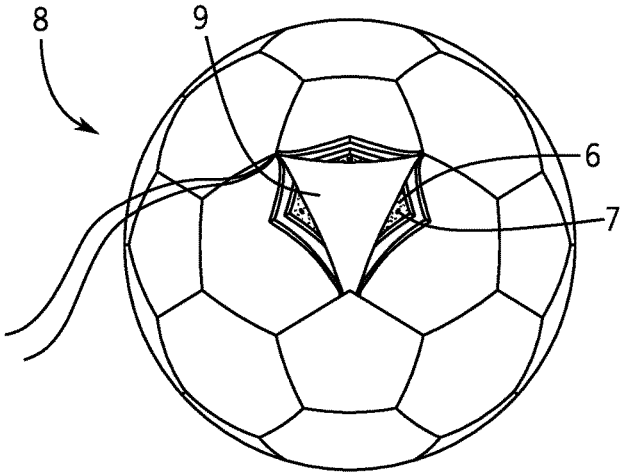
FIG. 9 is a front view of a ball cover after turning right-side out.

FIG. 9 shows the right-side out ball cover 8 after the cover turning step 150. Inlet opening 9 is used to turn the cover right-side out as shown in FIG. 9.

Figure 10:
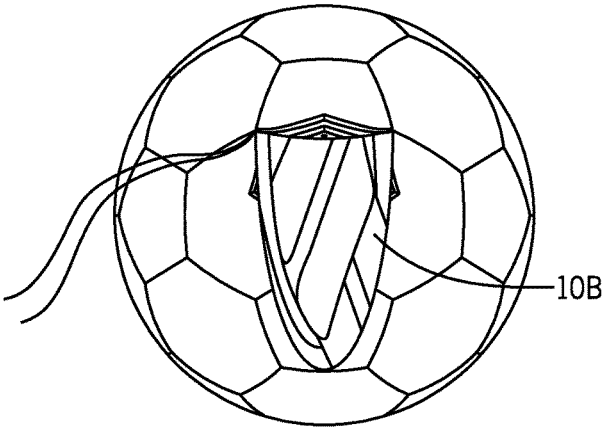
FIGS. 10 and 11 show front views of ball covers during insertion of a fabric-wrapped bladder or a string-wound bladder, respectively.
Figure 11:
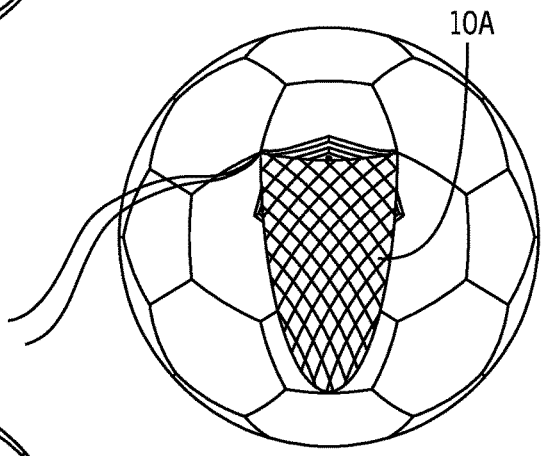
Figure 12:
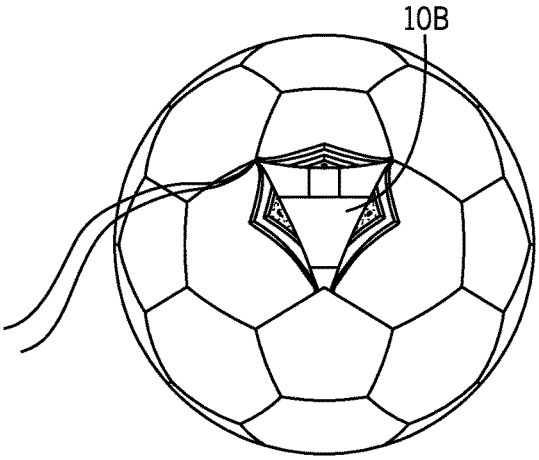
FIGS. 12 and 13 show front views of ball covers after insertion of a fabric-wrapped bladder or a string-wound bladder, respectively.
Figure 13:
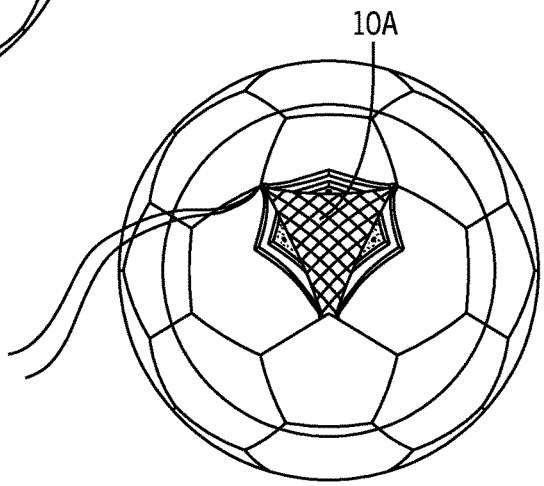

The next step is the bladder insertion step 160. The restricted bladder is deflated prior to insertion. The insertion of restricted bladder 10A (yarn-wound) is shown in FIG. 10, and insertion of restricted bladder 10B (fabric-wrapped) is shown in FIG. 11. The bladder is inserted through inlet opening 9 in the bladder insertion step 160. The bladder is affixed and/or adhered to the internal valve hole padding layer 14, which has the perforated holes 7 and the valve hole 15. The valve of the bladder is inserted into the valve hole 15. FIGS. 12 and 13 show the ball cover after the bladder insertion step 160, ready for the final closing process 170.

Figure 14:
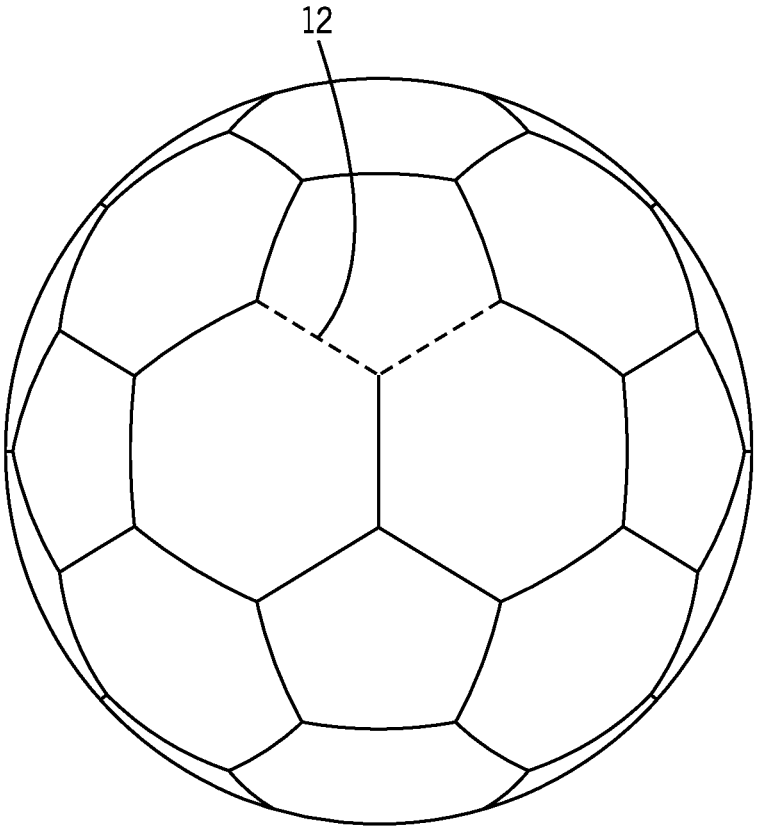
FIG. 14 is a front view of a ball cover after final closure by stitching.

FIG. 14 shows the closed ball cover after the inlet opening 9 has been closed by the closure stitching 12 conducted in the closing step 170. The closure stitching 12 is done preferably by first sewing shut the first seam or first part of the seam by sewing machine, and then sewing shut the remaining two seams or remaining parts by hand stitching. The approximate length of the lines of machine sewing is up to about 45 mm. The approximate length of the lines of hand stitching is about 80 mm to 160 mm. Preferably, each seam or part of hand stitching has five to six holes and four to five stitches per one inch (or per 25.4 mm).

Figure 15:
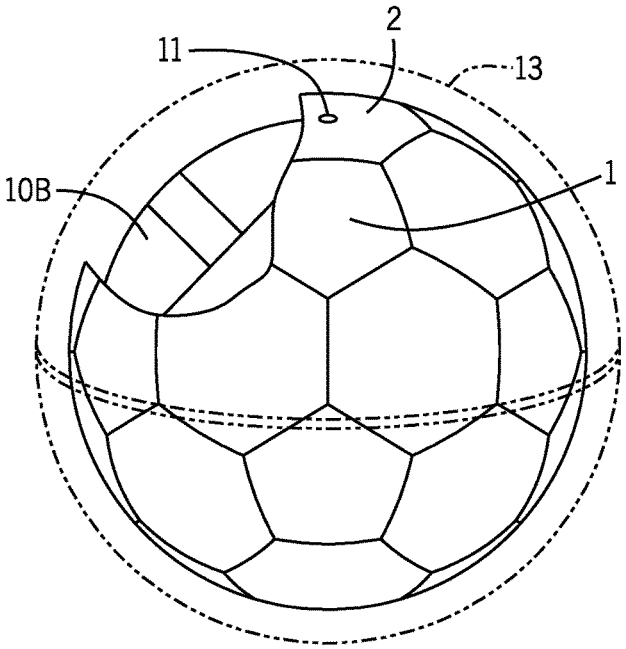
FIG. 15 is a schematic representation of a ball cover containing a fabric wrapped bladder during molding.
Figure 16:
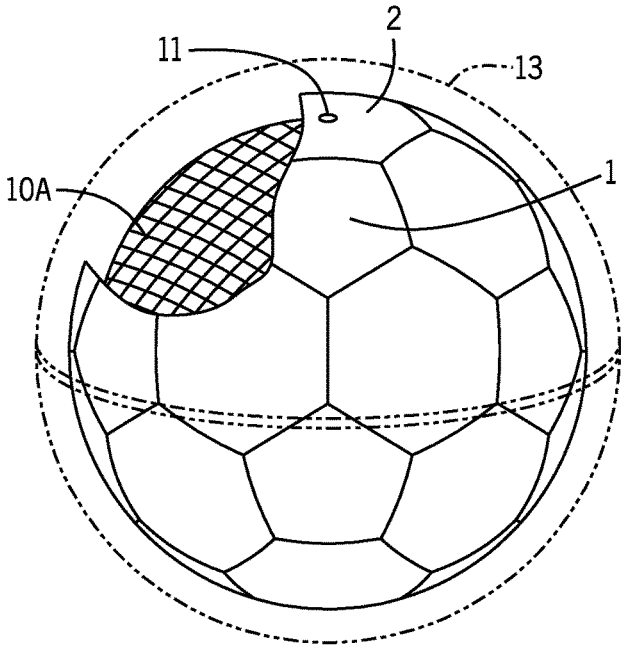
FIG. 16 is a schematic representation of a ball cover containing a string wound bladder during molding.

FIGS. 15 and 16 show schematic views of the closed ball inside a mold for the final molding step 180. Before molding, air under pressure is injected into the restricted bladder that has been sewn inside the ball cover during closing step 170, so that the bladder is inflated during the molding process. This pressure expands the bladder and compresses the structure of the ball cover 8. After air injection, the ball is placed inside a molding device, such as the shaping molds 13 schematically depicted in broken lines in FIGS. 15 and 16, shown surrounding sewn-shut balls with cut-away portions showing the wrapped, inflated bladders within. In molding step 180, the mold 13 is sealed shut, and forced heat and pressure are applied to the ball in the mold 13. This final shaping step 180 plays two major roles. Heat activates the glue 3A on the edges of each of the panels 1, and starts the welding process in the seams between adjoining panels 1. Heat also softens the panels 1, the internal padding layer 6, and the internal valve padding layer 14. As the result of the mold step 180, the sports ball has uniform panels 1 which are welded together at their adjoining edges by the activated glue 3B, and has a consistent round shape with the correct volume to comply with game play regulations. This final shaping mold step 180 welds 3B the sports ball, makes uniform any uneven stitching, and forces the sports ball to have the best possible round shape. It basically plays the role of "ironing" the ball into its final shape. After molding and cooling, the finished ball may preferably have its bladder deflated for shipping.

Figure 17C:
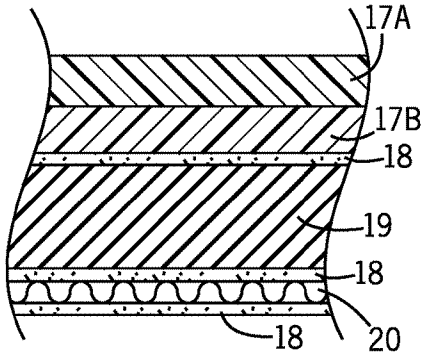
FIG. 17C is a cross-sectional view of the panel taken along line 17C-17C of FIG. 17B.
Figure 17B:
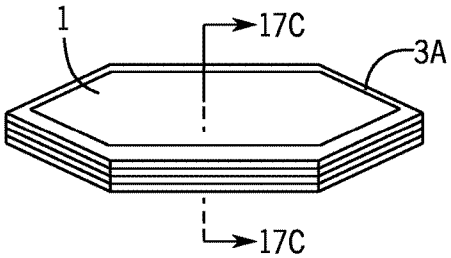
FIG. 17B is a side perspective view of a cut-out panel.
Figure 17A:
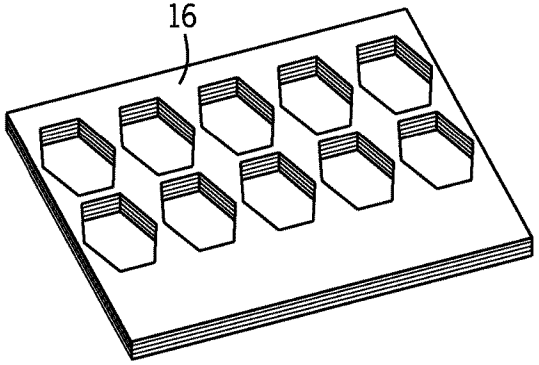
FIG. 17A is a schematic representation showing a first sheet material from which panels are cut.

FIGS. 17A-17C show details of the material that is used to form the outer ball cover. The plurality of panels 1 is cutouts from a first sheet material 16, which is a laminated sheet material. The laminated first sheet 16 is preferably comprised of six layers of components laminated together, namely, upper casing material 17, multiple layers of adhesive 18, rubber foam 19, and fabric 20. These layers are described below, respective of the position of each in lamination:

- $1^{st}$ layer: Upper (outer) casing material 17 which consists of leather or synthetic leather. This material can be TPU (Thermo Polyurethane) film, PU (Polyurethane) synthetic leather, and/or PVC (Poly Vinyl Chloride) synthetic leather. The upper casing material has an upper (outer) side 17A and a bottom (inner) side 17B. TPU film is a film with a thickness between 0.1 mm-0.30 mm. The PU synthetic leather may preferably have a thickness between 0.30 mm-1.3 mm. The PVC synthetic leather may preferably have a thickness between 0.55 mm-1.6 mm.
- $2^{nd}$, $4^{th}$ and $6^{th}$ layers: Adhesive 18. These layers preferably are comprised of a latex adhesive which is in the form of natural rubber with 60% dry rubber content (DRC) and 40% water. In alternate embodiments, one or more of these layers may alternatively be applied after cutting instead of being laminated within the sheet material.

$3^{rd}$ layer: Rubber foam 19, which preferably is EVA (Ethylene Vinyl Acetate) foam, POE (Polyolefin) foam, and/or EPDM (Ethylene Propylene Diene Monomer) foam.

$5^{th}$ layer: Fabric 20 preferably is a woven cloth or textile.

The layers above are depicted in FIG. 17C. In the cutting step 110, cutouts as shown in FIG. 17B are made from the above-described laminated first sheet material 16 depicted in FIG. 17A to form the outer panels 1 of the ball, in a predetermined shape according to the type and style of ball to be made. The heat reactive glue 3A is coated onto the peripheral edges of the upper (outer) surface 17A of each panel 1.

In the cutting step 110, cutouts also are made from the second sheet material 21, shown in FIGS. 18A-18C and described below, to form the internal padding layer 6, and from the laminated third sheet material 22 to make the internal valve padding layer 14.

Figure 18C:
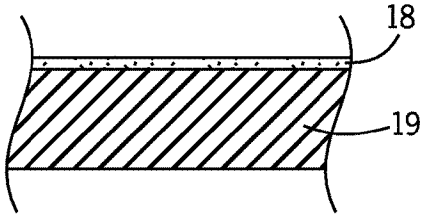
FIG. 18C is a cross-sectional view of the internal padding layer taken along line 18C-18C of FIG. 18B.
Figure 18B:
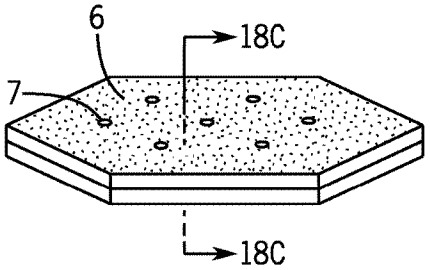
FIG. 18B is a side perspective view of a cut-out internal padding layer.
Figure 18A:
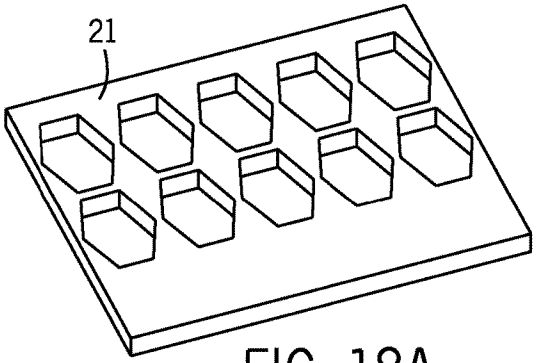
FIG. 18A is a schematic representation showing a second sheet material from which internal padding layer pieces are cut.

FIG. 18A is a schematic representation showing details of the second sheet material 21 that forms the internal padding layer 6. A plurality of cutouts are made from the second sheet material 21 as depicted in FIG. 18B. As shown in FIG. 18C, the second sheet 21 is preferably comprised of a rubber foam layer 19.

Preferably, this rubber foam 19 of FIGS. 18A-18C is EVA (Ethylene Vinyl Acetate) foam, POE (Polyolefin) foam, and/or EPDM (Ethylene Propylene Diene Monomer) foam. The internal padding layer cut-outs 6 are thus comprised of one layer of rubber foam at the time they are cut from the second sheet material 21.

Later, a layer of adhesive 18 will be coated onto this foam layer 19 of cut-out internal padding layer pieces 6 during the internal padding layer application step 140. This later-added adhesive coating layer is represented as the adhesive layer 18 on top of the foam layer 19 in FIG. 18C. The adhesive layer 18 preferably is comprised of a latex adhesive which is in the form of natural rubber with 60% dry rubber content (DRC) and 40% water. In alternative embodiments, the adhesive layer 18 is a layer laminated onto foam layer 19 before the cutting step. In alternative embodiments, a second (bottom) adhesive layer 18 also is laminated onto the opposite side of the foam layer from the first (top) adhesive layer 18.

The cutouts 6 are cut in a predetermined shape to correspond to the shape of the respective panel 1 of the ball to which the cutout 6 is to be affixed. A number of perforations (perforated holes 7) are perforated, cut, or punched into the second sheet material 21 during the cutting process 110. A cutting tool used to cut the cutouts of the internal padding layer 6 preferably plays two major roles: it cuts out the padding layer pieces in the predetermined shape, and at the same time it makes the perforations 7 in the padding layer. The size of each internal padding layer cutout 6 with the perforated holes 7 is smaller than that of the corresponding panel 1 of the ball cover. Preferably, the cutting tool makes the perforations 7, but alternatively the second sheet material 21 can be used that already contains perforations 7.

The perforated holes 7 in the internal padding layer 6 provide surprising effects of extra softness, bounce, and play responsiveness to the finished sports ball. This is because the holes 7 form an "air spring" having a springing effect within the area of the gap between the exterior surface of the restricted bladder 10A, 10B and the interior surface of the outer ball cover 8.

Figure 19C:
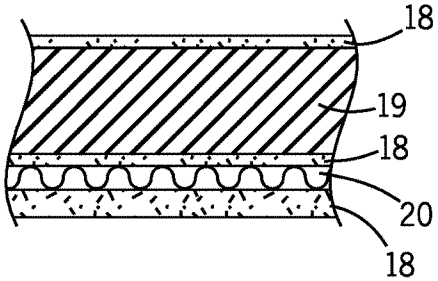
FIG. 19C is a cross-sectional view of the internal valve padding layer taken along line 19C-19C of FIG. 19B.
Figure 19B:
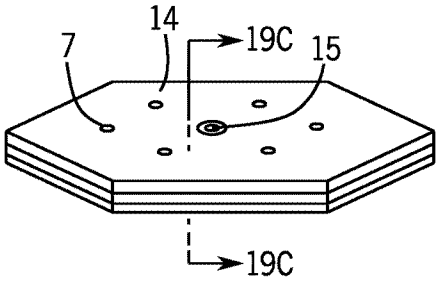
FIG. 19B is a side perspective view of a cut-out internal valve padding layer.
Figure 19A:
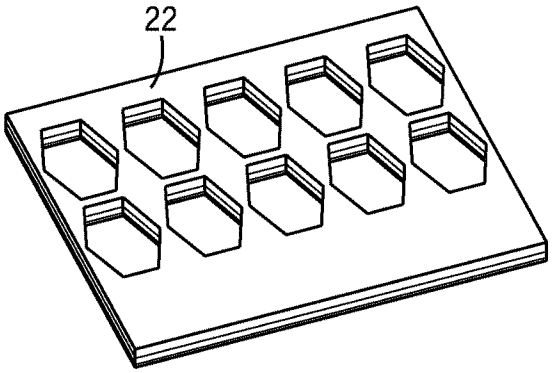
FIG. 19A is a schematic representation showing a third sheet material from which internal valve padding layer pieces are cut.

FIGS. 19A-19C show schematic representations of details of the material that forms the internal valve padding layer 7. For each ball, a cutout for padding the inside of the bladder valve hole panel 2 is made from the laminated third sheet 22. The laminated third sheet 22 is preferably comprised of five layers of components laminated together; rubber foam 19, multiple layers of adhesive 18, and fabric 20, as shown in FIG. 19C and described below:

$1^{st}$, $3^{rd}$ and $5^{th}$ layer: Adhesive 18. The adhesive layers 18 preferably are comprised of a latex adhesive which is in form of a natural rubber with 60% dry rubber content (DRC) and 40% water. In alternate embodiments, one or more of these layers may alternatively be applied after cutting instead of being laminated within the sheet material.

$2^{nd}$ layer: Rubber foam 19. Preferably the rubber foam layer 19 is an EVA (Ethylene Vinyl Acetate) foam, POE (Polyolefin) foam, and/or EPDM (Ethylene Propylene Diene Monomer) foam.

$4^{th}$ layer: Fabric 20. Fabric 20 preferably is a woven cloth or textile.

In a preferred embodiment, all three of the rubber foam layers 19 are the same thickness. That is, the rubber foam layer 19 of the laminated third sheet 22 is the same thickness as the rubber foam layer 19 of the laminated first sheet 16, and of the rubber foam layer 19 of the second sheet 21.

The cutout for padding the inside of the bladder valve hole panel 2 is made from the laminated third sheet 22, and a valve hole 15 is cut, punched, or perforated into the interior valve padding layer 14. Also, the internal valve padding layer 14 has perforations or holes 7 cut, punched, or perforated into it as part of the cutting process 110. The valve hole 15 receives insertion of the bladder valve.

After the cutout of the internal valve padding layer 14 with perforated holes 7 and valve hole 15 is made in the predetermined shape corresponding to the shape of the valve hole panel 2, the internal valve padding layer 14 is pasted and or adhered onto the bottom layer of valve hole panel 2 of ball cover in an inside out position, which will become the innermost layer of the panel 2 after inversion. The internal valve padding layer 14 is perforated with holes and the valve hole 15 during the cutting process 110, resulting in the shape shown in FIG. 19B. A cutting tool used to cut the internal valve padding layer 14 plays two major roles; it cuts out the internal valve padding layer 14 in the predetermined shape, and at the same time it creates the holes 7 and the valve hole 15 in the internal valve padding layer 14. Alternatively, the laminated third sheet material 22 can already contain the perforations 7 prior to cutting. The size of the internal valve padding layer cutout 14 with the perforated holes 7 and valve hole 15 is smaller than that of the corresponding valve hole panel 2 of the ball cover.

Similarly to those of the cutouts 6, the perforated holes 7 made in the internal valve padding layer 14 (see FIG. 19B) also provide the surprising spring effect, with extra softness, bounce, and responsiveness of the sports ball. This is because the holes 7 form an air spring having a springing effect within the area of the gap between the exterior surface of the restricted bladder 10A, 10B and the interior surface of the outer ball cover 8.

The valve hole 15 in the internal valve padding layer 14 has the same hole size (diameter) as the valve hole formed in the outer valve panel 2 of the ball cover 8. This allows the bladder valve 11 to easily be inserted up to valve of ball cover 8. The correct size also helps achieve strong affixation and or adhering of the restricted bladder 10A, 10B to the internal valve padding layer 14.

Figure 20:
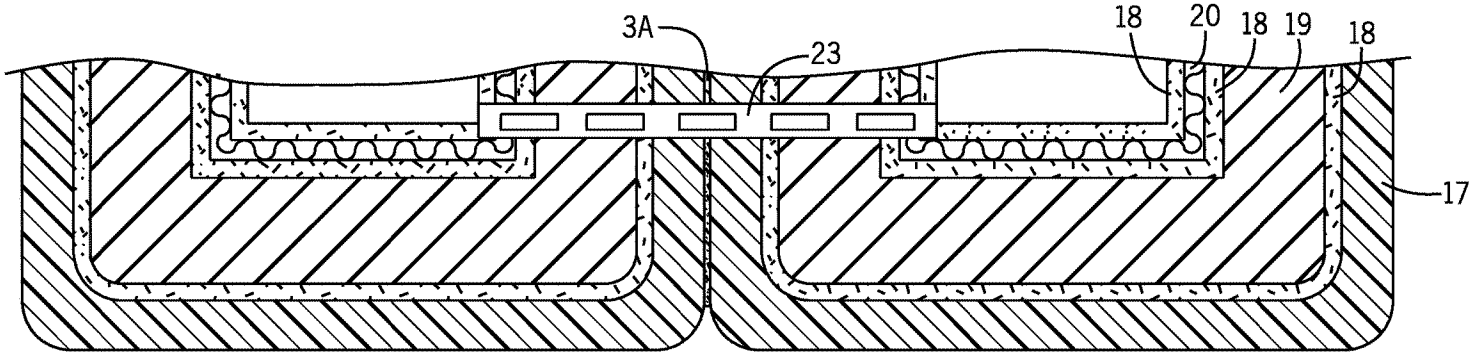
FIG. 20 is a schematic representation of a cross-sectional view showing two adjoining panels stitched together.
Figure 21:
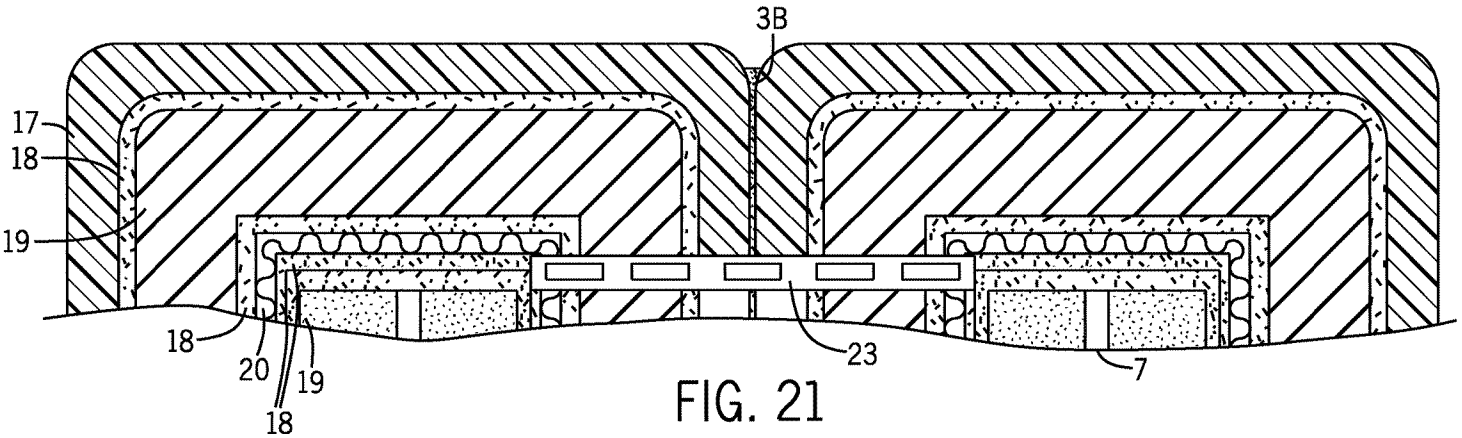
FIG. 21 is a schematic representation of a cross-sectional view showing two adjoining panels stitched together, with adhered internal padding layer, after molding step.
Figure 22A:
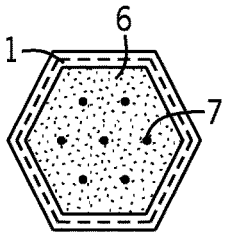
FIGS. 22A-22B are bottom side views of cut-out panels of representative cut-out shapes with internal padding layers adhered thereto, in a representative embodiment.
Figure 22B:
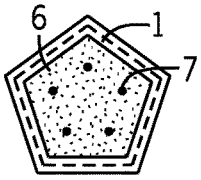
Figure 23A:
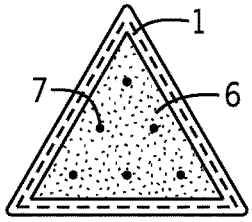
FIGS. 23A-23B are bottom side views of cut-out panels of representative cut-out shapes with internal padding layers adhered thereto, in another embodiment.
Figure 23B:
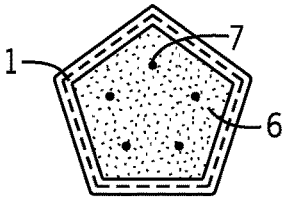
Figure 24A:
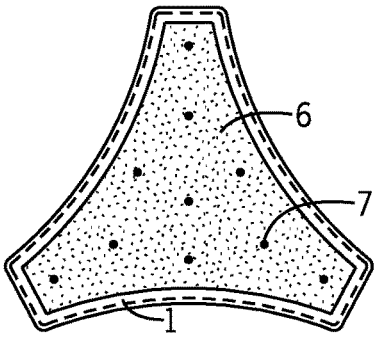
FIGS. 24A-24C are bottom side views of cut-out panels of representative cut-out shapes with internal padding layers adhered thereto, in another embodiment.
Figure 24B:
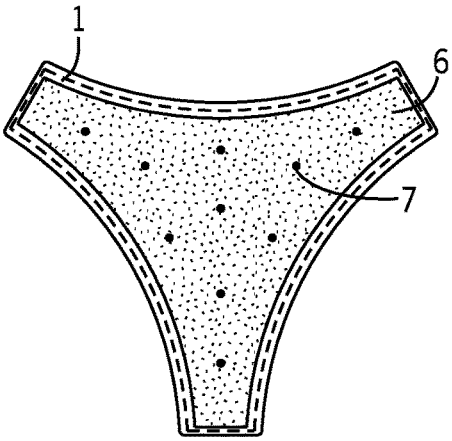
Figure 24C:
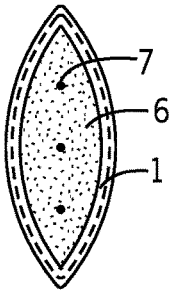
Figure 25:
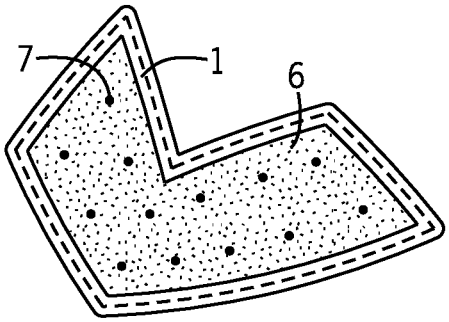
FIG. 25 is a bottom side view of a cut-out panel of a representative cut-out shape with an internal padding layer adhered thereto, in another embodiment.
Figure 26:
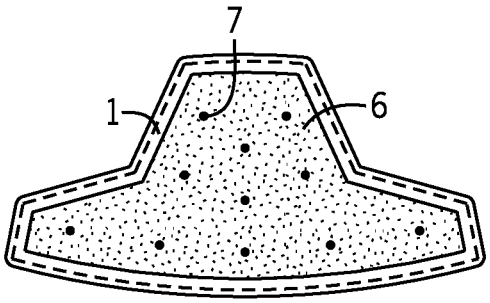
FIG. 26 is a bottom side view of a cut-out panel of a representative cut-out shape with an internal padding layer adhered thereto, in another embodiment.

FIG. 20 is a schematic representation of a cross-sectional view showing two adjoining panels 1,1 stitched together after the stitching step 130. FIG. 21 is a schematic representation of a cross-sectional view showing two adjoining panels 1, 1 stitched together, with their respective adhered internal padding layer cutouts 6, 6, shown after the molding step 180. As can be seen by comparing FIG. 20 to FIG. 21, the glue 3A has been changed by the molding process 180, insofar as that the applied heat and pressure have converted the glue 3A into activated glue 3B, which tightens the stitches 23 and helps to fill in the seams, to reduce any loose space between adjoining panels 1, 1. Activated glue 3B has been expanded by the heat and pressure such that it spreads and emerges a bit above stitching area, as shown at the top of the view of FIG. 21, thus covering up the stitches to make the seams appear to be stitch-free. After heating and cooling, the cooled glue shrinks back very slightly. The activated glue 3B in the seam between two panels 1, 1 bonds the panel to its adjoining panel by crosslinking.

This bonding activation via heat makes a stronger strength of bonding after cooling, and the expanded glue 3B makes the stitching invisible in the preferred embodiment. Thus the appearance of the finished ball is similar to that of a laminated and/or thermo-bonded ball such as the official soccer balls used in the 2014 World Cup held in Brazil.

A number of examples of alternative panel shapes that may be employed in the invention are shown in FIGS. 22A-22B, 23A-23B, 24A-24C, 25, and 26. The shapes are preferably the typical panel shapes known in the sports industry, particularly in the soccer industry. As seen in these figures, panel shapes used to form a given sports ball need not always be the same shapes. A set of panels sewn together to form a given sports ball can comprise panels of two or more shapes, and/or can comprise panels of different sizes. In a preferred embodiment of the invention herein, all panels are of the hexagonal and pentagonal shapes, and are sewn together to form a spherical sports ball.

While the invention has been illustrated and described in detail in the drawings and foregoing description, the same is to be considered as illustrative and not restrictive in character, it being understood that only certain exemplary embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary, and embodiments lacking the same and excluding the same also may be contemplated as within the scope of the invention, the scope being defined by the claims that follow. In reading the claims, it is intended that when words such as "a," an," "at least one," or "at least one portion" are used there is no intention to limit the claim to only one item unless specifically stated to the contrary in the claim. When the language "at least a portion" and/or "a portion" or "portions" is used the item can include a portion and/or the entire item unless specifically stated to the contrary.

LIST OF REFERENCE NUMERALS

1 cut-out panel
E1 side edge of cut-out panel
2 cut-out valve hole panel
3A pre-activated adhesive on panel edges
3B activated adhesive on panel edges
E3 edge of band of glue coating
4 inside-out ball cover
5 inside-out ball cover with applied internal padding layer
6 cut-out internal padding layer
7 perforated holes in internal padding layer
8 right-side out (turned) ball cover
9 inlet opening
10A bladder with yarn winding
10B bladder with fabric wrapping
11 valve
12 closure stitching
13 mold
14 internal valve padding layer
15 valve hole in internal padding layer
16 laminated first sheet material for panels
17 outer casing of panel
17A upper outermost side of panel outer casing (top surface of panel)
17B bottom side of panel outer casing
18 adhesive layer
19 foam layer
20 fabric layer
21 second sheet material for internal padding layer
22 laminated third sheet material for internal valve padding layer
23 stitching
23X stitch line
100 manufacturing method
110 cutting step
120 adhesive application step
130 stitching step
140 internal padding layer application step
150 cover turning step
160 bladder insertion step
170 closing step
180 molding step

The invention claimed is:

1. A method for manufacturing a sports ball, comprising:

cutting a plurality of outer panels from a first sheet material, a plurality of internal padding layer cut-outs from a second sheet material, and an internal valve padding layer cut-out from a third sheet material, wherein the internal valve padding layer cut-out comprises a valve hole and a plurality of perforations, and the internal padding layer cut-outs comprise a plurality of perforations, and the plurality of perforations in the internal valve padding layer cut-out and in the internal padding layer cut-outs do not extend through the outer panels;

applying onto a top surface of each of the panels, along peripheral edges of the top surface, a layer of heat-reactive adhesive that expands upon heating;

stitching together adjoining panels of the plurality of panels along respective edges of the adjoining panels, such that the stitching joins adjoining panels with the top surfaces of the respective adjoining panels facing one another at seams to form an inside-out cover, leaving an inlet opening unstitched;

attaching one of the internal padding layer cut-outs to a bottom surface of each one of the stitched panels;

attaching the internal valve padding layer cut-out to a valve hole panel that is comprised of one of the panels having a valve hole;

turning the inside-out cover to be right-side out, such that the internal padding layer is inside the right-side out cover;

inserting a reinforced deflated bladder into the cover, and inserting a valve of the bladder into both of the valve holes;

stitching the inlet opening closed;

inflating the bladder inside the cover;

applying heat and pressure from the exterior of the cover to mold the ball and cause expansion of the heat-reactive adhesive to cover the stitching in the seams and weld the seams.

2. The method of claim 1, further comprising a bladder reinforcing step comprising forming a reinforcement layer surrounding the bladder by winding string or yarn wound around the bladder and adhering the string or yarn to the bladder with adhesive.

3. The method of claim 1, further comprising a bladder reinforcing step comprising forming a reinforcement layer surrounding the bladder by adhering one or more layers of fabric to the bladder with adhesive.

4. The method of claim 1, wherein the first sheet material comprises an upper casing material layer, multiple adhesive layers, a foam layer, and a fabric layer, all laminated together.

5. The method of claim 4, wherein the upper casing material layer comprises leather, thermo polyurethane film, polyurethane synthetic leather, or polyvinyl chloride synthetic leather.

6. The method of claim 1, wherein the second sheet material comprises a foam layer.

7. The method of claim 6, wherein the foam layer comprises rubber foam, ethylene vinyl acetate foam, polyolefin foam, or ethylene propylene diene monomer foam.

8. The method of claim 1, wherein the third sheet material comprises a foam layer, a fabric layer, and multiple adhesive layers, all laminated together.

9. The method of claim 8, wherein the foam layer comprises rubber foam, ethylene vinyl acetate foam, polyolefin foam, or ethylene propylene diene monomer foam.

10. The method of claim 1, wherein the cutting step comprises using a cutting tool that makes the perforations.

11. The method of claim 4, wherein the second sheet material comprises a foam layer;

the third sheet material comprises a foam layer, a fabric layer, and multiple adhesive layers, all laminated together; and the foam layer of the first sheet material, the foam layer of the second sheet material, and the foam layer of the third sheet material have the same thickness.

12. The method of claim 1, wherein the layer of heat-reactive adhesive is applied to the top surface of the panels along the peripheral edges in a band that has a total width of approximately 3.5 mm to 4 mm.

13. A sports ball, comprising:

a cover formed from a plurality of outer panels cut from a first sheet material;

an internal padding layer formed from a plurality of internal padding layer cut-outs cut from a second sheet material;

an internal valve padding layer formed from an internal valve padding cut-out cut from a third sheet material; and a bladder comprising a valve, wherein the internal valve padding layer cut-out comprises a valve hole and a plurality of perforations, the internal padding layer cut-outs comprise a plurality of perforations, the plurality of perforations in the internal valve padding layer cut-out and in the internal padding layer cut-outs do not extend through the outer panels, the panels comprise a layer of heat-reactive adhesive that expands upon heating, applied to a top surface of the panels along peripheral edges of the top surface of the panels, the cover is formed by stitching together adjoining panels of the plurality of panels along respective edges of the adjoining panels, such that the stitching joins adjoining panels with the top surfaces of the respective adjoining panels with the heat-reactive adhesive disposed thereupon facing one another at seams to form an inside-out cover, one of the internal padding layer cut-outs is attached to a bottom surface of each one of the stitched panels, the internal valve padding layer cut-out is attached to a bottom surface of a valve hole panel which is comprised of one of the panels having a valve hole, the bladder is disposed inside the cover turned right-side out, with the valve of the bladder inserted through both of the valve holes to extend to an exterior surface of the cover, and the seams of the cover are welded by the heat-reactive adhesive being expanded by heat so as to cover the stitching in the seams.

14. The ball of claim 13, further comprising a bladder reinforcing step comprising forming a reinforcement layer surrounding the bladder by winding string or yarn wound around the bladder and adhering the string or yarn to the bladder with adhesive.

15. The ball of claim 13, further comprising a bladder reinforcing step comprising forming a reinforcement layer surrounding the bladder by adhering one or more layers of fabric to the bladder with adhesive.

16. The ball of claim 13, wherein the first sheet material comprises an upper casing material layer, multiple adhesive layers, a foam layer, and a fabric layer, all laminated together.

17. The ball of claim 16, wherein the upper casing material layer comprises leather, thermo polyurethane film, polyurethane synthetic leather, or polyvinyl chloride synthetic leather.

18. The ball of claim 13, wherein the second sheet material comprises a foam layer.

19. The ball of claim 18, wherein the foam layer comprises rubber foam, ethylene vinyl acetate foam, polyolefin foam, or ethylene propylene diene monomer foam.

20. The ball of claim 13, wherein the third sheet material comprises a foam layer, a fabric layer, and multiple adhesive layers, all laminated together.

21. The ball of claim 20, wherein the foam layer comprises rubber foam, ethylene vinyl acetate foam, polyolefin foam, or ethylene propylene diene monomer foam.

22. The ball of claim 13, wherein the cutting step comprises using a cutting tool that makes the perforations.

23. The ball of claim 16, wherein the second sheet material comprises a foam layer;

the third sheet material comprises a foam layer, a fabric layer, and multiple adhesive layers, all laminated together; and the foam layer of the first sheet material, the foam layer of the second sheet material, and the foam layer of the third sheet material have the same thickness.

24. The ball of claim 13, wherein the layer of heat-reactive adhesive is applied to the top surface of the panels along the peripheral edges in a band that has a total width of approximately 3.5 mm to 4 mm.

* * * * *